US005992773A

United States Patent [19]

Schwechten

[11] Patent Number: 5,992,773

[45] Date of Patent: Nov. 30, 1999

[54] METHOD FOR FLUIDIZED BED JET MILL GRINDING

[75] Inventor: Dieter Schwechten, Augsburg, Germany

[73] Assignee: Hosokawa Alpine Aktiengesellschaft, Augsburg, Germany

[21] Appl. No.: 09/108,502

[22] Filed: Jul. 1, 1998

[30] Foreign Application Priority Data

Jul. 3, 1997 [DE] Germany ..... 197 28 382

[51] Int. Cl.[6] ..... B02T 19/06

[52] U.S. Cl. ..... 241/5; 241/25; 241/39

[58] Field of Search ..... 241/5, 39, 101.8, 241/25

[56] References Cited

U.S. PATENT DOCUMENTS

| | | | |
|---|---|---|---|
| 1,935,344 | 11/1933 | Andrews et al. | 83/46 |
| 4,592,302 | 6/1986 | Motoyama et al. | 118/303 |
| 4,602,743 | 7/1986 | Nied | 241/5 |
| 5,035,405 | 7/1991 | Reuter | 266/250 |
| 5,133,504 | 7/1992 | Smith et al. | 241/5 |
| 5,247,052 | 9/1993 | Lucke et al. | 528/125 |
| 5,423,490 | 6/1995 | Zampini . | |
| 5,447,275 | 9/1995 | Goka et al. | 241/5 |
| 5,494,520 | 2/1996 | Lamendola et al. | 118/608 |
| 5,562,253 | 10/1996 | Henderson et al. | 241/5 |
| 5,683,039 | 11/1997 | Leute et al. | 241/5 |
| 5,695,132 | 12/1997 | Gorzka Jr. et al. | 241/39 |
| 5,716,751 | 2/1998 | Bertrand et al. | 430/137 |

FOREIGN PATENT DOCUMENTS

| | | |
|---|---|---|
| 0 601 511 A1 | 12/1992 | European Pat. Off. . |
| 5 98 421 | 5/1934 | Germany . |
| 27 38 980 | 8/1977 | Germany . |
| 27 38 930 A1 | 3/1979 | Germany . |
| 36 20 440 A1 | 12/1987 | Germany . |
| 42 41 549 A1 | 6/1994 | Germany . |
| 42 43 438 C2 | 6/1996 | Germany . |
| 195 13 035 C2 | 10/1996 | Germany . |
| WO 90/06179 A1 | 6/1990 | WIPO . |

*Primary Examiner*—Joseph J. Hail, III
*Assistant Examiner*—William Hong
*Attorney, Agent, or Firm*—Pennie & Edmonds LLP

[57] ABSTRACT

The method and apparatus for impact pulverization by directing at least one high-velocity gas or vapor jet exiting from a nozzle into a fluidized bed of milling material, wherein the gas or vapor jet is jointly accelerated with a portion of the milling material and thereafter directed into the fluidized bed of milling material.

9 Claims, 4 Drawing Sheets

METHOD FOR FLUIDIZED BED JET MILL GRINDING

BACKGROUND OF THE INVENTION

This invention relates to a fluidized-bed jet-mill pulverization method, whereby a high-velocity gas or vapor jet exiting from a nozzle is directed at a fluidized bed of granular material. The particles around the jet are accelerated to a velocity where their impact on particles stationary or moving in the opposite direction causes these to break up. A method of this type has been described earlier in the German patent (DE-PS) 5 98 421.

More recent developments in the realm of fluidized-bed jet mills have focussed on improved particle charging of the fluid jets entering the fluidized bed.

What current state-of-the-art methods still need is an improved pulse exchange between the high-velocity, high-kinetic-energy gas or vapor jets and the granular, nearly stationary, low-kinetic-energy material in the fluidized bed.

Typically, a pulse exchange between the gas or vapor jet and the granular material takes place almost exclusively in the envelope section of the gas or vapor jets. The particle velocity perpendicular to the flow direction is not enough to permit penetration into the center of the gas jet. As a result, the high velocities in the core area of the jet remain largely unutilized in the pulverization process.

A first solution to the problem is disclosed in DE 42 43 438 C2 and corresponding U.S. Pat. No. 5,423,490, the disclosure of which is incorporated herein by reference. This involved a better utilization of the energy carried by the jet by increasing the ratio of the material to be pulverized relative to the gas or vapor jets used for the fluidized-bed jet milling process.

According to that solution, the pulse exchange between the gas or vapor jet and the granular material is to be improved by means of flow channels, provided perpendicular to the flow direction of the jet in the low-pulse areas directly behind the point where the jet exits the nozzle, which channels produce a pressure drop from the surrounding area toward the core of the jet, causing the particles of the milling material to be sucked in toward the center of the jet, where they are accelerated to the impact velocity needed for pulverization.

A shortcoming of this earlier process lies in the fact that the particles of the milling material initially display very little kinetic energy and are accelerated only by the high kinetic energy of the gas or vapor jet. In the process there are substantial differences in velocity between the gas or vapor jet and the as yet accelerated particles of the milling material due to the mass inertia of the particles. Consequently, considerable slippage is likely which in turn causes losses in the flow rate due to turbulences. These flow-rate losses negatively affect economical, cost-effective pulverization that would require a minimum amount of energy.

It follows that accelerating the particles together with the fluid is especially efficient. This phenomenon is also utilized in retro-jet fluid-energy mills employing jet pipes. A method along that line is described in DE 36 20 440 A1 where the bulk material to be broken down is introduced in a pressure extractor chamber and is then expanded i.e. pressure-reduced into a feed pipe together with the precompressed carrier gas and accelerated. In that process, each two jet nozzles operate in mutually opposing directions. Particle pulverization is obtained by the mutual crushing of colliding particles. The drawback here is that the milling effect is limited since each particle is exposed to only one single, one-time break-down impact. Many particles are not broken down at all since the jet coming from the opposite direction deflects them from the impact zone in the center of the jet toward the outside, preventing them from colliding with other particles in the area of the jet.

This has been remedied by directing one particle jet against a solid target, thus assuring that each accelerated particle is subjected to a collision. A process employing that method is described in DE 27 38 980 A1. Its drawback again lies in the high rate of wear of the stationary target.

SUMMARY OF THE INVENTION

The core objective of this invention therefore lies in utilizing the advantages of particle acceleration in jet pipes (i.e. low turbulence-induced flow-rate losses) for efficacious pulverization in fluidized-bed jet mills, without wear.

The invention is aimed at increasing the pulverization efficiency of jet milling in a fluidized bed by minimizing the turbulence-induced flow-rate losses resulting from large velocity differentials between the gas or vapor jet and the milling-material particles. Specifically, the intent is to obtain the smallest possible flow-rate losses in spite of high particle densities in the gas or vapor jets.

This is accomplished in that the gas or vapor jets are accelerated together with a portion of the granular milling material and directed into a fluidized bed of milling material.

When exiting from the nozzle, a jet, optimally charged in accordance with this invention, can interact with the surrounding fluidized bed. This interaction with the surrounding fluidized bed in the form of particle collisions and the added drawing-in of particles into the jet takes place with a lower level of flow-rate losses and reseults in an improved energy utilization of the particle jet.

The particles, accelerated without requiring much energy, can be broken down to a fine powder through appropriate impact treatment in the fluidized bed. This pulverization process takes place with the participation of all particles including the accelerating particles from the jet pipes and the accelerated particles from the fluidized bed.

One desirable implementation version of this invention provides for the use of portions of the millinc material from the bottom section of the fluidized bed of the jet mill as feed material for particle acceleration together with the gas or vapor jet. This is particularly advantageous due to the separating effect of the fluidized bed since especially coarse and/or heavy particles tend to accumulate in that section. More than any others, these heavy particles resist being adequately drawn into a free jet and accelerated within the fluidized-bed jet mill and emphasis should therefore be given to accelerating them together with the gas or vapor jet.

DETAILED DESCRIPTION OF THE INVENTION

Figure 1:
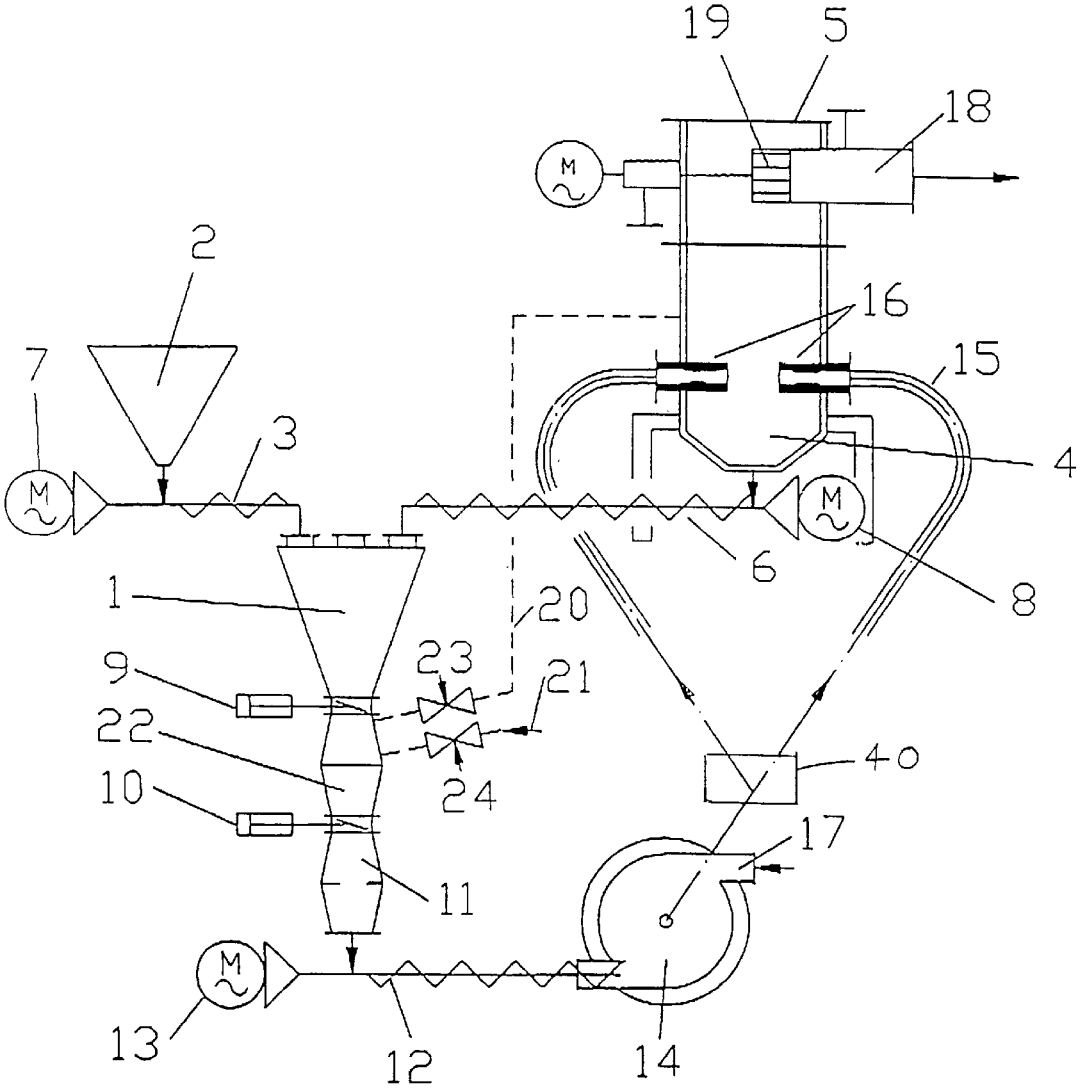
FIG. 1 is a schematic view of a system designed for implementing the method according to this invention.

The milling material to be pulverized is loaded into the feed hopper 1. The milling material may consist of fresh feed material which is added in proportionally controlled quantities via the funnel 2 and the metering screw 3, or it may be coarse material drawn from the lower section of the fluidized bed 4 of the retro-jet mill 5.

The particles taken from the fluidized bed 4 are carried out of the fluidized bed 4 by means of a feed screw 6. To the extent required, fresh feed material and recirculated milling material can be mixed in variable proportions and fed in. The quantitative ratio of the material added by way of the proportional metering screw 3 and the feed screw 6, respectively, is governed by the mutually independent, speed-controllable motors 7 and 8.

The milling material placed in the feed hopper 1 is transported to the pressure chamber 11 via a sluice gate system consisting of pressure-tight valve plates 9 and 10 and the lock chamber 22. The lock chamber is operated in the alternating pressure mode by way of actuator-driven valves 23 and 24 in the hydraulic connection 21 and the expansion i.e. depressurizing line 20.

A high-pressure screw conveyor 12 serves to transport the feed material within the pressurized area while the motor 13 determines the rotational speed of the screw, thus controlling the proportional amount of milling material metered out into the gas or vapor jet. The charge ratio is in the range from 0.5 to 5.0 kg of milling-material flow volume per each kg of gas or vapor flow volume.

Figure 2A:
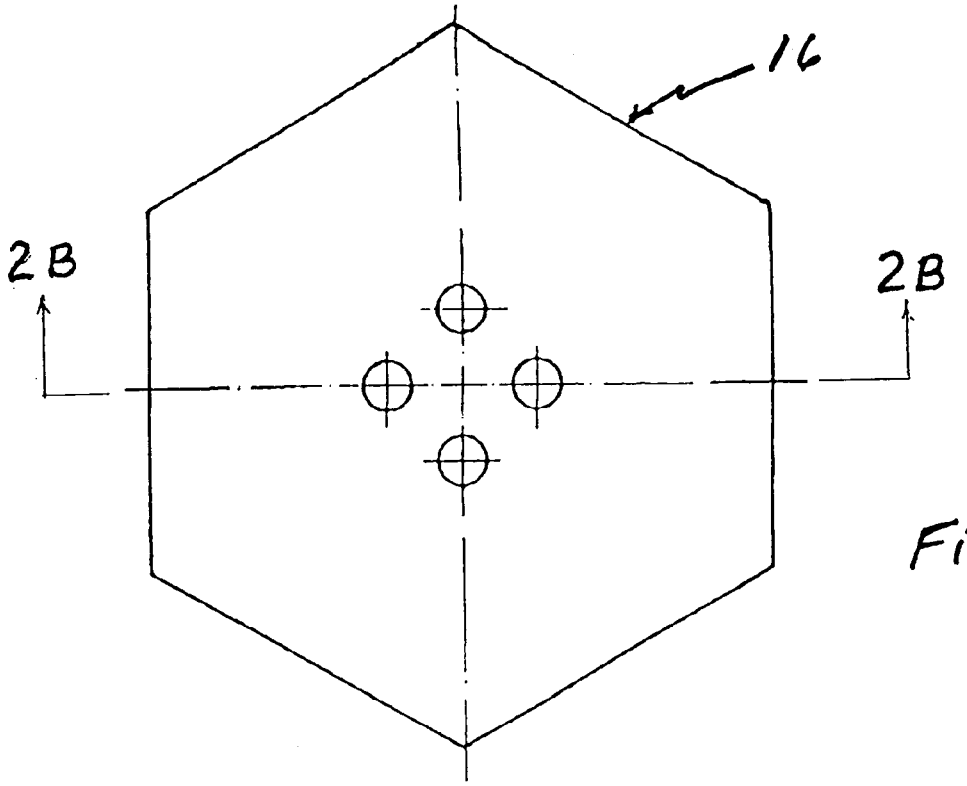
FIG. 2A is a plan view of a nozzle structure usable with the system of the present invention.
Figure 2B:
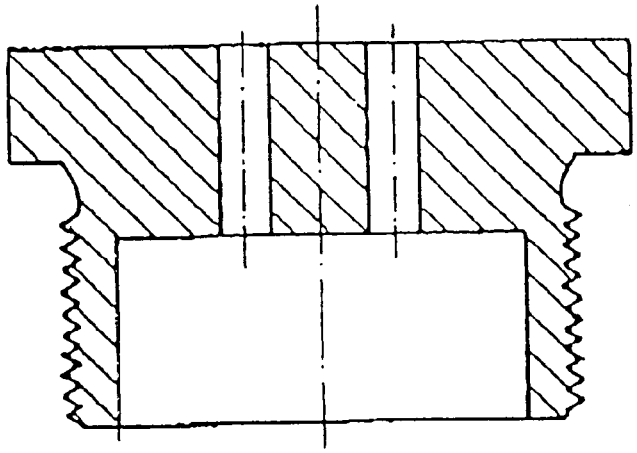
FIG. 2B is a side cross-sectional view of the nozzle of FIG. 2A, taken along lines 2A—2A.

In the mixing chamber 14 the pressurized milling material introduced via the milling-gas intake 17 is dispersed in the milling gas or vapor and is fed to the retro-jet fluidized-bed jet mill 5 by way of the jet pipes 15. The expansion/pressure reduction of the particle-charged high-pressure jet into the retro-jet mill 5 takes place via the nozzles 16 directly into the fluidized bed 4. Upon exiting from the nozzles, the gas or vapor jet can be charged with an additional portion of milling material which may be obtained from the fluidized bed of milling material. For this purpose, nozzles according to U.S. Pat. No. 5,423,490 and as shown in FIGS. 2A and 2B is used. The nozzles will be arranged below the level oa the fluidized bed whereby additional material from the fluidized bed will be drawn into the gas jets exiting from the nozzles. The pulverized material produced in the milling process exits the mill and the processing loop via the ground-material discharge port 18 of the separator-sifter 19.

Figure 3:
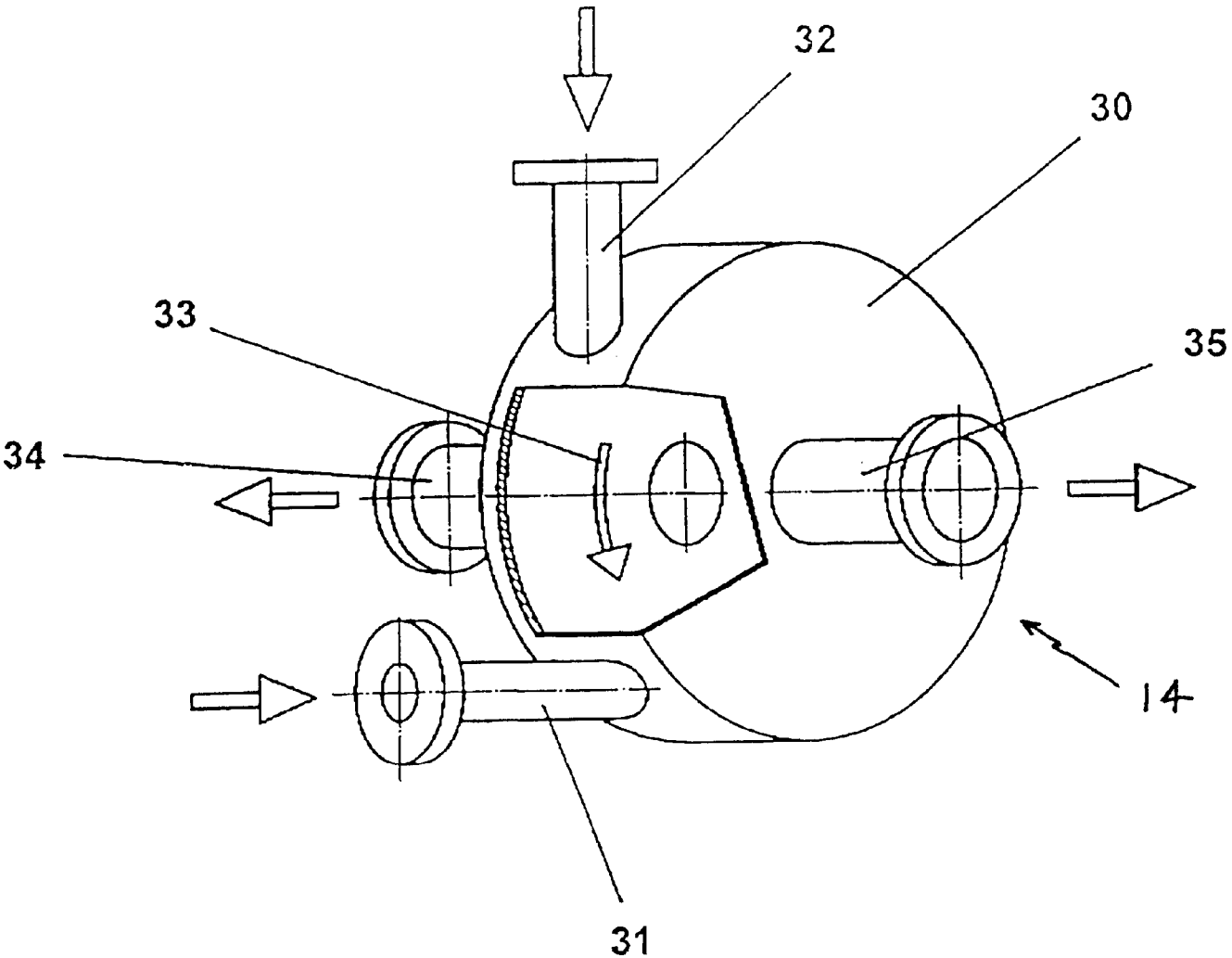
FIG. 3 is a schematic view of the mixing chamber, partly broken away to show the interior, as used in the system of the present invention.

The mixing chamber 14 (FIG. 1) is shown in detail in FIG. 3 and comprises a cylindrical housing 30. The diameter of the housing is much greater than the height in the axial direction. Therefore the housing is in flat cylindrical shape. The milling material is introduced into the chamber 14 by the high-pressure screw conveyor 12 leading into the intake port 31. The high-pressure air is introduced into the chamber 14 by the inlet 32. The air flow is introduced tangentially into the chamber 14, which will effect a rotating air stream 33 in which the fed milling material is mixed uniformly in a continuous constant amount. The milling material is therefore dispersed into the air stream in a very efficient way.

Two outlet ports 34 and 35 are arranged in a center location of the cylindrical housing 30 on opposite sides thereof to discharge the mixed high-pressure air and milling material mixture with the same velocity and pressure. Each outlet leads into a jet pipe 15 (FIG. 1) which supplies the nozzles 16 (FIG. 1).

Each of the two counter-jets of the fluidized-bed jet mill 5 (FIG. 1), which are located in opposition to each other are supplied by two outlets 34 and 35 of the same mixing chamber 30, to ensure equal jet-velocity and jet-pressl at the nozzles 16 (FIG. 1) which are located in opposition to each other.

Figure 4:
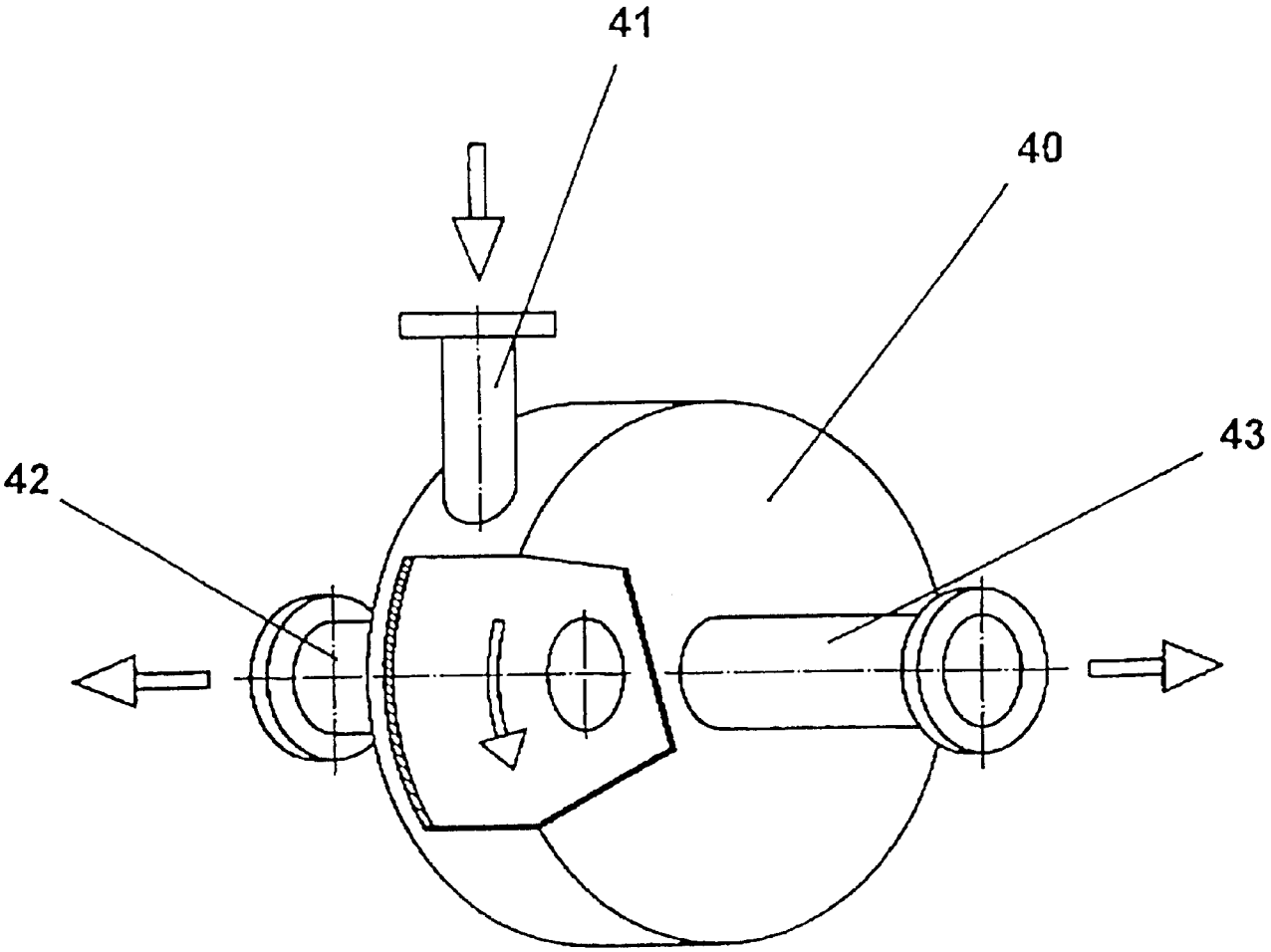
FIG. 4 is a schematic view of the distribution chamber, partly broken away to show the interior, as used in the system of the present invention.

One or more distribution chambers 40 can be connected downstream from the mixing chamber 14 for the purpose of distributing joint flow of milling material and gas or vapor into multiple jet pipes 15. The distribution chamber 40, shown in FIG. 4, is built in a similar manner to the mixing chamber of FIG. 3 whereby the already mixed suspension of air and milling material is introduced into the chamber 40 by the intake port 41 and will then be discharged through two outlet ports 42 and 43 which are located opposite to each other. When using four or more (6, 8 or 10) nozzles within the fluidized-bed jet mill, a distribution chamber is necessary for each two nozzles. For example, for operating a fluidized-bed jet mill with 4 nozzles, one mixing chamber 14 and two distribution chambers 40 are employed.

List of Reference Numbers

(1) Feed hopper
(2) Funnel
(3) Metering screw
(4) Fluidized bed
(5) Retro-jet fluidized-bed jet mill
(6) Feed screw
(7) Metering-screw motor
(8) Feed-screw motor
(9) Upper slide-valve plate
(10) Lower slide-valve plate
(11) Pressure chamber
(12) High-pressure screw conveyor
(13) Motor of high-pressure screw conveyor
(14) Mixing chamber
(15) Jet pipes
(16) Nozzles
(17) Milling-air intake
(18) Pulverized-material discharge port
(19) Separator-sifter
(20) Expansion/pressure-reduction line
(21) Hydraulic line
(22) Sluice-gate lock chamber
(23) Expansion-line valve
(24) Hydraulic-line valve

I claim:

1. A method for impact pulverization by directing at least one high-velocity gas or vapor jet exiting from a nozzle into a fluidized bed of milling material having a first pressure, which comprises the steps of:

drawing a portion of milling material from a lowest section of the fluidized bed of milling material for joint acceleration with each gas or vapor jet;

accelerating each gas or vapor jet having a second pressure jointly with the portion of the milling material; and directing each gas or vapor jet and the portion of milling material through the nozzle and into the fluidized bed of milling material.

2. The method according to claim 1, which further comprises charging the gas or vapor jet with an additional portion of the milling material after the jet enters the fluidized bed through the nozzle.

3. The method according to claim 2, further comprising drawing the additional portion of the milling material from the fluidized bed of milling material.

4. The method according to claim 1, further comprising accelerating the gas or vapor jet in jet pipes jointly with a portion of the milling material.

5. The method according to claim 1, further comprising expanding the gas or vapor jet sufficiently to reduce the second pressure below the first pressure of the fluidized bed after the jet enters the fluidized bed through the nozzle.

6. The method according to claim 1, further comprising directing at least two gas or vapor jets toward one another after the jets enter the fluidized bed.

7. The method according to claim 6, wherein the jets are directed so as to meet at a common point.

8. The method according to claim 7, wherein the common point is located within the fluidized bed.

9. The method according to claim 1, further comprising combining (a) the gas or vapor jets accelerated jointly with milling material with (b) gas or vapor jets accelerated without milling material, before entering the fluidized bed.

* * * * *